United States Patent [19]

Alnafissa

[11] Patent Number: 4,801,149

[45] Date of Patent: Jan. 31, 1989

[54] EDUCATIONAL PLAYING CARDS

[76] Inventor: Fahad A. Alnafissa, 1433 Santa Monica Blvd., #4, Santa Monica, Calif. 90404

[21] Appl. No.: 110,729

[22] Filed: Oct. 21, 1987

[51] Int. Cl.[4] ..... A63F 1/00

[52] U.S. Cl. ..... 273/302; 273/304

[58] Field of Search ..... 273/304, 302, 292

[56] References Cited

U.S. PATENT DOCUMENTS

| | | | |
|---|---|---|---|
| 1,012,574 | 12/1911 | Adams | 273/304 X |
| 2,162,946 | 6/1939 | Garrison | 273/304 |
| 3,935,651 | 2/1976 | Mankoff et al. | 273/304 X |
| 4,234,189 | 11/1980 | Chunn | 273/302 X |
| 4,558,865 | 12/1985 | Isgar | 273/302 X |

*Primary Examiner*—Carlton R. Croyle
*Assistant Examiner*—Eugene L. Szczecina, Jr.
*Attorney, Agent, or Firm*—Robert S. Smith

[57] ABSTRACT

A deck of 52 playing cards divided into 4 suits of 13 cards each, the thirteen cards in each suit respectively bearing the following indicia and sets of answers and questions

| Card Indicia | Sets of Answers and questions |
|---|---|
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| Boy | 12 |
| Girl | 12 |
| Old Man | 13 |
| Ace | 11 |

3 Claims, 3 Drawing Sheets

EDUCATIONAL PLAYING CARDS

BACKGROUND OF THE INVENTION

This invention relates to educational card games, and more specifically to a game utilizing a novel deck of cards in a question-and-answer format to combine pleasure and learning over a wide range of subject matter.

The prior art in this general field includes the following United States patents:

| | |
|---|---|
| 4,219,197 | Acuff |
| 4,234,189 | Chunn |
| 4,306,725 | Sawyer |
| 4,428,582 | Smith |
| 4,512,746 | Turner |

Acuff's invention is a word-forming game, utilizing a 68-card deck and a six-sided die, and is based on the game of poker.

Chunn discloses a fifty-two card deck divided into four suits, each suit being representative of two different parts of speech, and each card in each suit represented by two different letters of the alphabet.

Sawyer's game utilizes a deck of fifty-two cards, each bearing a letter of the alphabet, a numeral, and word definitions; it is played using a spin dial which uniquely identifies one of the fifty-two cards.

Smith uses a deck of 130 cards, (or tiles), with letters on one side and numbers on the reverse side.

Turner's mathematical teaching cards consist of twelve decks of thirty-six cards each, for a total of 432 cards in all; it is primarily a teaching tool—game-playing is secondary.

It is an object of this invention to combine education with pleasure by using the playing cards in a question-and-answer system which can be designed to cover a wide range of subject matter.

SUMMARY OF THE INVENTION

It has now been found that these and other objects of the invention may be attained in a deck of 52 playing cards divided into 4 suits of 13 cards each, the thirteen cards in each suit respectively bearing the following indicia and number of sets of answers and questions.

| Card Indicia | Sets of Answers and questions |
|---|---|
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| Boy | 12 |
| Girl | 12 |
| Old Man | 13 |
| Ace | 11 |

In some forms of the invention the questions and answers are on the same face of the card.

DESCRIPTION OF THE PREFERRED EMBODIMENT

The invention consists of a deck of 52 cards, designed to provide an educational exercise in any desired basic category, such as Word History, Geography, Sports, Art, Music, or the like.

The accompanying drawings show, as an illustrative example, a deck designed for the basic category "Vocabulary", and which will be described in more detail below.

Figure 1:
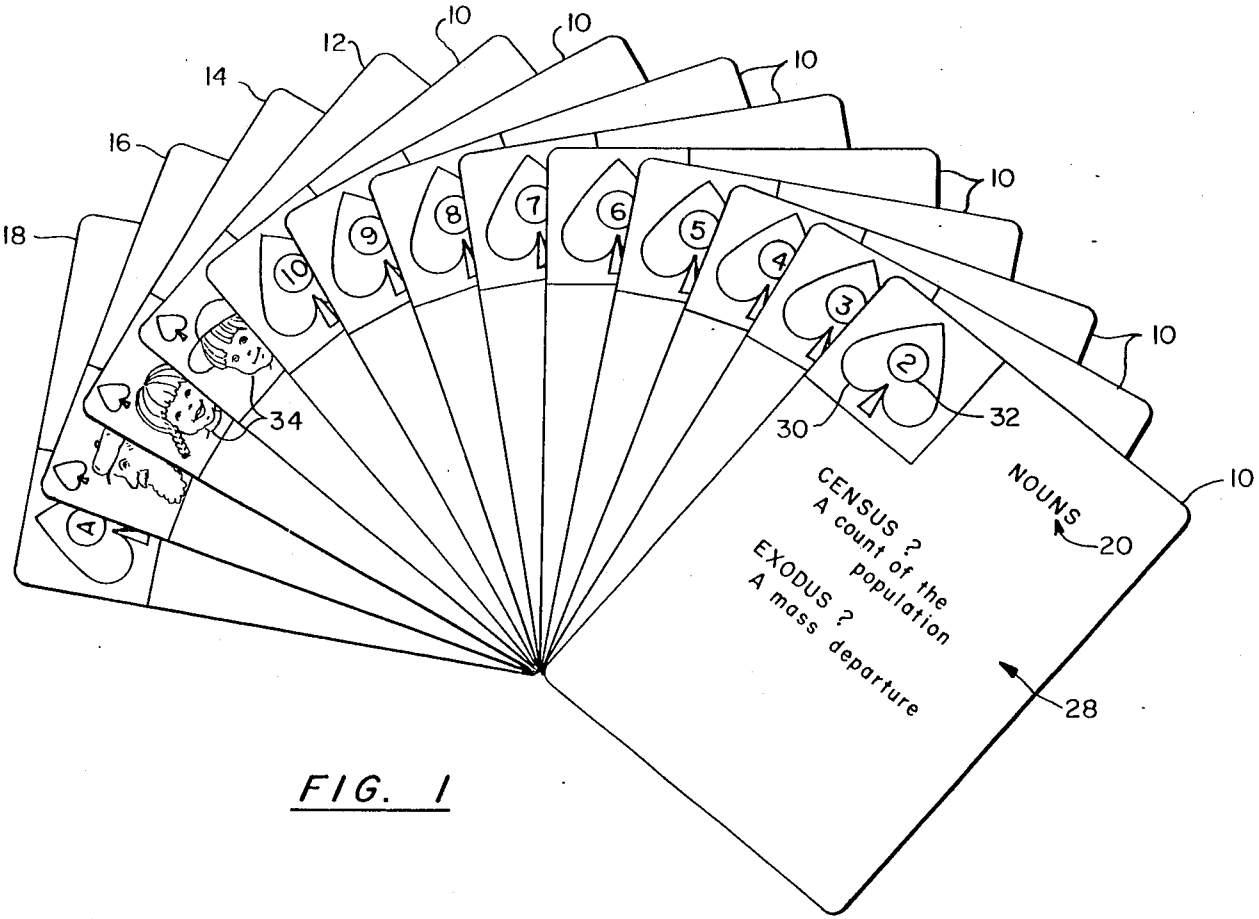
FIG. 1 shows the thirteen cards that make up one of the four suits in the deck of cards in accordance with the invention.
Figure 2:
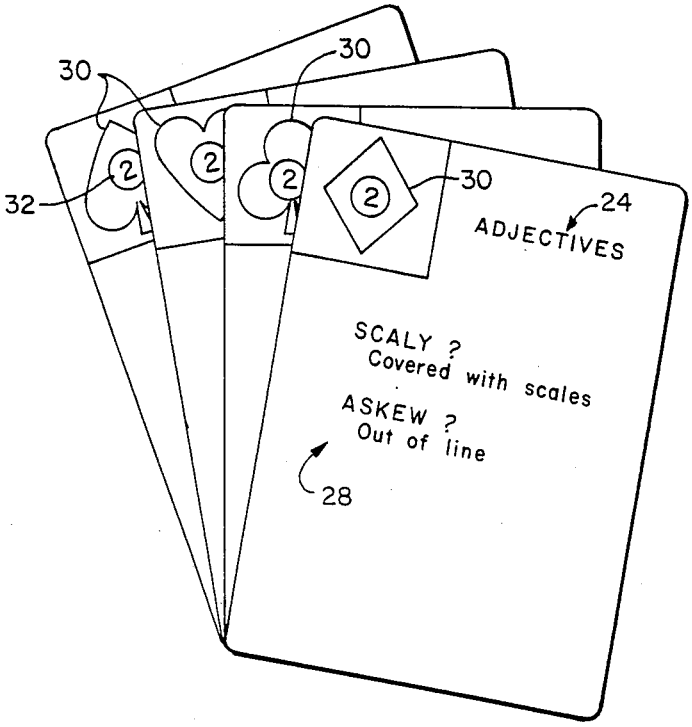
FIG. 2 shows a card from each of the four suits and each bears a similar level number indicator.

The deck is divided into the four commonly used suits: spades, clubs, hearts, and diamonds. FIG. 1 shows the thirteen cards of the spade suit. The other suits are similar. Each suit contains nine cards 10 numbered two to ten inclusive and three picture cards: a boy 12, a girl 14, and an old man 16, and the ace 18. Each card has, on its face in a small area in one of its upper corners, its suit sign 30 and number 32 (or picture 34).

Figure 3:
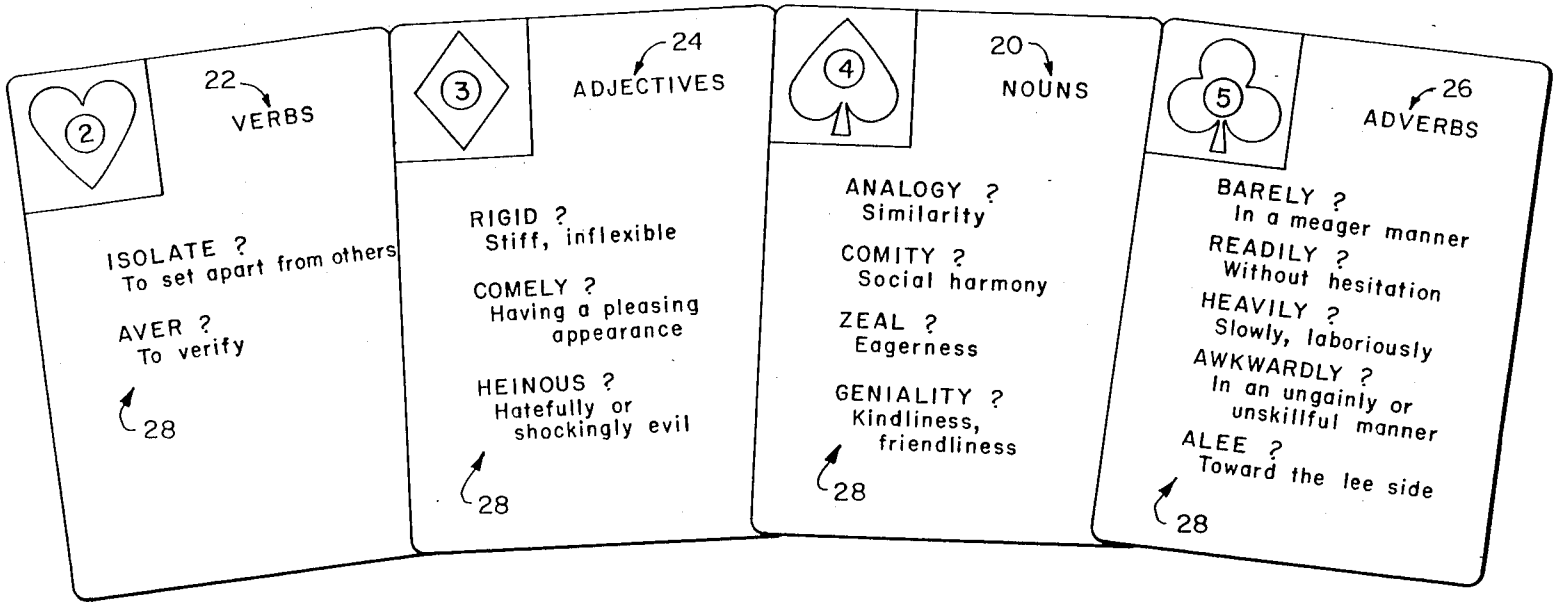
FIG. 3 shows a card from each of the four suits and each bears a different level number indicator.

Each suit represents a sub-category related to the main category. In the example shown, each suit corresponds to one of four parts of speech: nouns 20, verbs 22, adjectives 24, and adverbs 26. (See FIG. 3).

On each card appears two or more questions 28, (and answers), pertaining to that particular card's sub-category. The number of the card, (or the assumed value of the picture), indicates: (a) the number of questions on the card (b) level (of difficulty) (c) the value of the card for point scoring, to be explained later. These values are listed below:

For example, any card with the number 7 will have 7 questions with the respective answers. The ace will have 11 questions of the highest skilled level and accordingly, that card will be the one of the most valuable cards. The boy and girl cards will have 12 questions each and each old man card will have 13 questions which will be of the lowest level of information. The skill level between card number 2 and 10 will be of increasing level of difficulty.

| Card | Value | |
|---|---|---|
| 2 | 2 | Lowest level of skill |
| 3 | 3 | Increasing higher level of skill |
| 4 | 4 | Increasing higher level of skill |
| 5 | 5 | Increasing higher level of skill |
| 6 | 6 | Increasing higher level of skill |
| 7 | 7 | Increasing higher level of skill |
| 8 | 8 | Increasing higher level of skill |
| 9 | 9 | Increasing higher level of skill |
| 10 | 10 | Increasing higher level of skill |
| Boy | 12 | Increasing higher level of skill |
| Girl | 12 | Increasing higher level of skill |
| Old Man | 13 | Lowest level of skill |
| Ace | 11 | Highest level of skill |

The rules governing questioning procedures for specific cards are outlined below:

Old Man:

Four questions must be asked from this card of each player, for which: Three right answers give a positive point and two wrong answers give a negative point. A player holding four Old Man cards in his hand is penalized by having to give one of them to his opponents, each of whom ask him two questions from that card; he will gain no positive points for correct answers, but will get negative points for wrong answers.

Ace

Three questions from this card must be asked of each opponent for which:

Three right answers give a positive point

Two right answers give no point

Two wrong answers give a negative point.

A player holding four aces in one hand is penalized by having to trade one of them to each of three opponents in exchange for one card from each of their hands. When played, any ace can take with it for it's owner five cards from the table. These cards will be saved for the counting at the end of the round.

Boy, Girl

Two questions must be asked from this card for which:

Two right answers give a positive point

One right answer gives no point

Two wrong answers give a negative point

When played on the table, these cards permit the holder of the card to take three cards for his or her owner.

Ten to Six incl.

One question must be asked from any of these cards, for which:

Right answer gives one positive point

Wrong answer gives one negative point.

Five to Two incl.

One question must be asked from any of these cards, for which:

Right answer gives one positive point

No negative point for wrong answer.

In addition, the third opponent being questioned from the Two card will get a positive point without having to answer any question.

Ordinarily, the cards will have on one face their numbers and pictures with symbols in a small area in one of the upper corners. Alternatively, this indicia may be all over the entire face in a shadowy print. On this same face there will be questions and answers in a concise form. The back of each card will have a colorful design in the usual manner. The side of the cards ordinarily will range from $2\frac{1}{4} \times 3\frac{1}{2}$ inches to $3 \times 5$ inches. The materials used for making the cards will be those conventionally used.

It is preferable that the game with is played with four players, although more or fewer can be accommodated. Each player competes as an individual. One player designated as dealer will shuffle and deal out the cards, one by one, until the deck is exhausted. All players must have an equal number of cards; if there are any excess cards they are set aside and not used.

Play will ordinarily advance to the right around the table at which the players will ordinarily be seated. (The players may agree, however, to have players advance to the left if they so wish.)

The player next in sequence after the dealer opens the play by selecting one of his cards and asking questions from that card of his first opponent, who gets positive or negative points according to the correctness of his answers. The first opponent will ordinarily be to the immediate right of the player who opens play. All other players will sequentially be opponents for the player who opens play.

After the questioning from any one card is complete the starting player lays that card face up on the table on top of the table pile. Such cards will be deposited on the table pile until the end of the round. (Certain cards, when played on the table allow the player to take back a prescribed number of cards, to be set aside and later counted as points for him in the final scoring.) Each player has a score sheet upon which he records the positive or negative points of his opponents during his questioning. After the starting player completes his questioning, the play passes to the second player, who conducts his own questioning session in a like manner. This continues around the table at which the players are seated. After all the players have had their turn at questioning, each player tallies up his positive and negative points from his opponents' score sheets, and counts the points representing the cards he has taken from the table pile in the course of play.

The manner of play will be better understood by the following description of the manner of play. As player A has his turn reached, player A asks questions of each of his three opponents (assuming there are 4 people playing the game). As each opponent answers a question player A will call either "right" or "wrong" and he will correct any wrong answers and record each persons score on his individual score sheet. All three questions must be from the same card if the card has three questions on it. After all questions are answered, player A will discard the card from which he has been asking his questions with the questions faced up on the table (on top of the cards already on the table, if there were any). The play will then continue with the adjacent player.

The cards are regarded as regular cards and special cards. The regular cards are all the cards with numbers 3 to number 10. The special cards are cards with the number 2, the aces, the boy, the girl and old man cards. The special cards are denoted as special cards for one or more of the following reasons: (1) they have a special questioning system, (2) they have a special case in their questioning system, or (3) they have effects on the other cards on the table when they are dropped on top of the other cards. In the case of cards with number 2 designation, the player asking questions from this card will only be able to answer questions from two of his opponents and the third opponent will automatically get a positive point without being questioned. In the case of the cards denoted by the A symbol, which have 11 questions on each card, the player will call one question loudly to all the others notifying them by saying "listen". Any opponent of that player who upon hearing the specific question shouts the right answer first will receive a positive point while the others will receive a negative point. In the case of two persons shouting the right answer at the same time, another question from that ace card will distinguish which of the two persons deserves the positive point. The first question will not be the basis for awarding any points to any of the players. In the case where all the players give wrong answers, all of these players will receive negative points after they have been told the correct answer.

In the case of both girl and boy cards, two questions will be directed to each opponent. A positive point will not be given unless the opponent answers both questions correctly. A negative point will not be recorded unless both answers are wrong. One right answer will gain no positive point, however, the opponent will not receive a negative point.

Whenever any player has at the start of any round, 4 old man cards, he will be punished by making one of his old man cards void. He will be allowed to keep the card until the last turn to give him more opportunities in selecting his questions, the last old man card cannot be used to question an opponent. Since the action will make the opponents actually lose the opportunity to answer some questions from that card, the card must be surrendered to the opponents at the last turn so that each one of them may ask the original holder of the card a question from the card. For these extra questions there will be no positive points for the right answers but negative points will be awarded for the wrong answers.

In the case where a player does not have any ace in any given round, the player will have the right to refuse to answer by saying "pass" whenever he so elects. That player only has to show his cards to the other at the first turn of the round to reserve his right for passing and not answering.

In the case where four aces are in a players hand at the beginning of any one round, the player must make an announcement at the beginning of the round (in order not to lose all his rights in that round) offering to exchange an ace. The player making the offer will then select an ace and call a question from it loudly (as described in the rules regarding aces above). The first person to shout the right answer to the question will receive that ace. The player who has surrendered the ace would select randomly a card from the cards of the person who has gained the ace and the play will proceed in the usual manner.

As each player completes questioning from a given card he places the card with the questions and answers uppermost on the table or on the stack of previously discarded cards. A fraction of a minute will be given for other players to check the discarded card in the event there is any doubt that the card thrown is different from the card from which questions have been asked. If the card thrown is different, 3 negative points will be recorded against the person who has discarded the card and one positive point will be awarded to each opponent.

If the card discarded is an ace, it will enable the original holder to take the ace and 5 cards on the top of the pile of discarded cards on the table. If the discarded card is a boy or a girl card, 3 cards from the cards on the top of the pile of discarded cards on the table will be taken. Discarding the old man card or any of the other cards will not give the person discarding the card the power to take any of the cards from the stack of discarded cards on the table. The cards that are taken from the stack of discarded cards on the table will be saved and set aside by the player taking them from the table. After finishing the round these cards will be counted with points equal to the number of their questions, e.g. 7 points for the card with number 7 and 11 points for the ace and so on. For every full 20 points so accumulated, 1 point will be recorded on the sheet of the holder of the cards. After counting the number of 20 point sets, an additional point will be awarded the holder of the cards for a point value between 15 and 19. Any point value less than 15 will not be the basis for awarding points. Cards with only 2 questions will be counted as having 3 card points for this purpose.

After each 5 rounds of play, the players will figure out their scores and each player sheets by calculating the algebraic sum of the points. For example, if player A had 18 positive points and 7 negative points for player B, the score would be a positive 11 points. The game ends when any players' points reaches 360.

For more complexity, additional rules may be added. To simplify the game, some of the rules may be eliminated. To hasten the end of the game, the final score may be 250 points or some other mutually agreed upon value.

The game, in accordance with the invention, requires 2 kinds of memory skills to succeed. More specifically, a memory to retain information to answer the questions on the cards as well as a memory to remember a competitor's knowledge in order to select questions most likely to be improperly answered. The game in this method of competition, creates an entertaining environment while a positive learning experience continues.

The present invention in very capable of teaching any kind of information as long as this information can be formed in short questions. This aspect of the invention is particularly important because there is a strong need for such a tool in different educational areas such as in teaching vocabulary to language students.

While specific embodiments of the invention have been disclosed above, it should be understood that various modifications within the spirit of the invention may occur to those skilled in the art. Therefore it is intended that no limitations be placed on the invention except as defined by the scope of the appended claims.

Having thus described my invention I claim:

1. A deck of 52 playing cards divided into 4 suits of 13 cards each, said thirteen cards in each suit respectively bearing the following indicia and sets of answers and questions

| Card Indicia | Sets of Answers and questions |
|---|---|
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| Boy | 12 |
| Girl | 12 |
| Old Man | 13 |
| Ace | 11 |

2. The deck of cards as described in claim 1 wherein: the questions and answers are on the same face of the card.

3. A deck of 52 playing cards bearing indicia corresponding to 4 suits of 13 ranked cards each, said 13 cards in each suit each bearing a plurality of sets of questions and answers, the number of sets of questions and answers on each card being related to the respective ranking of the card.

* * * * *